US008907201B2

(12) United States Patent
Jensen

(10) Patent No.: US 8,907,201 B2
(45) Date of Patent: Dec. 9, 2014

(54) DEVICE FOR PRODUCING PERCUSSIVE SOUNDS

(71) Applicant: Lars Otto Jensen, Shanghai (CN)

(72) Inventor: Lars Otto Jensen, Shanghai (CN)

( * ) Notice: Subject to any disclaimer, the term of this patent is extended or adjusted under 35 U.S.C. 154(b) by 258 days.

(21) Appl. No.: 13/650,131

(22) Filed: Oct. 12, 2012

(65) Prior Publication Data

US 2014/0102279 A1 Apr. 17, 2014

(51) Int. Cl.

| | |
|---|---|
| ***G10H 1/32*** | (2006.01) |
| ***G10D 1/08*** | (2006.01) |
| ***G10D 15/00*** | (2006.01) |

(52) U.S. Cl.

CPC . *G10D 1/08* (2013.01); *G10D 15/00* (2013.01)
USPC ..... 84/743

(58) Field of Classification Search

CPC ..... G10D 15/00; G10D 1/08; G10H 1/34; G10H 1/32
USPC ..... 84/743
See application file for complete search history.

(56) References Cited

U.S. PATENT DOCUMENTS

| | | | | |
|---|---|---|---|---|
| 3,375,747 | A | 4/1968 | Posey | |
| 3,853,031 | A * | 12/1974 | DeWitt et al. | 84/267 |
| 4,768,415 | A | 9/1988 | Gressett et al. | |
| 4,832,302 | A * | 5/1989 | Anderson et al. | 248/443 |
| 5,105,711 | A * | 4/1992 | Barnard | 84/744 |
| 6,091,013 | A | 7/2000 | Walker, Jr. et al. | |
| 6,369,304 | B1 | 4/2002 | Tucker | |
| 6,441,293 | B1 | 8/2002 | LaBarbera | |
| 6,723,908 | B2 | 4/2004 | Chapman | |
| 7,285,709 | B2 | 10/2007 | White | |
| 7,339,107 | B2 | 3/2008 | Remignanti | |
| 7,459,619 | B2 | 12/2008 | Gawenda | |
| 7,741,556 | B2 | 6/2010 | Demsey et al. | |
| 7,799,986 | B2 | 9/2010 | Ryle et al. | |
| 7,923,616 | B2 | 4/2011 | Hamilton | |
| 7,982,124 | B1 | 7/2011 | Landis et al. | |
| 8,148,624 | B2 * | 4/2012 | Raisanen | 84/737 |
| 8,153,871 | B1 | 4/2012 | Fagrelius | |

* cited by examiner

*Primary Examiner* — Jianchun Qin
(74) *Attorney, Agent, or Firm* — Steven H. Greenfield; Greenfield Invention and Patent Consulting, Inc.

(57) ABSTRACT

A device for producing percussive sounds while simultaneously playing a plucked stringed instrument such as a guitar is disclosed. A plate attached to the front panel of a guitar contains a pivoting arm assembly. The arm is placed below the guitar strings such that it enables the player's hand to strike the swinging arm at the completion of a strumming downstroke on the strings. This causes the arm to swing down causing the actuation of an electric switch which then actuates the transmission of a signal for playing the percussive sound. This may be accomplished within less than 0.01 seconds; therefore, the resulting percussive sound virtually coincides with striking of the swinging arm. The swinging arm is attached to the plate with a spring loaded mechanism in a way that the arm rebounds to its original position following the swing-down making the arm ready for the next hand strike.

17 Claims, 9 Drawing Sheets

DEVICE FOR PRODUCING PERCUSSIVE SOUNDS

FIELD OF THE INVENTION

The present invention relates to a device for producing a percussive backbeat sound for a plucking or strumming instrument such a guitar or a banjo. More specifically, the present invention relates to a device for producing percussive sounds, typically coinciding with the rhythmic element referred to as the backbeat, while attached to, and played simultaneously with the guitar or the banjo.

BACKGROUND OF THE INVENTION

A number of prior art references provide means for providing percussive sounds as a rhythmic accompaniment to the melodic and harmonic sounds produced by traditional means on a strummed or plucked instrument.

U.S. Pat. No. 3,375,747 is for a rhythm beating attachment for guitars and more specifically to an improved form of guard plate for a guitar to be used in lieu of the conventional guard plate.

U.S. Pat. No. 6,369,304 discloses a percussion addition for a stringed instrument, such as a guitar, comprised of a hollow disc with a face, and a hollow support adapted for connection to an off-set sound hole in a stringed instrument. The percussion addition may be provided as a kit with interchangeable percussion additions.

U.S. Pat. No. 6,441,293 describes a music and percussion system including a fully functional stringed hollow-body electric musical instrument, a floor unit, an interface unit, and connecting cables. The instrument includes a microphone, a pickup, and a plurality of transducers, also known as acoustic drum triggers that are mounted on selected interior surfaces within the instrument neck and body.

U.S. Pat. No. 7,923,616 relates to a stringed instrument for producing rapid tempo and more precise rhythmic strumming. The shape of the strumming apparatus allows simultaneous contact of two or more strings from a plurality of strings, and thereby allows chords to be more efficiently produced. In combination with the strumming apparatus, the stringed instrument includes an instrument body with recessed components on the front surface of the instrument body. Combining the strumming apparatus and an instrument body as in the present invention allows a user to achieve greater rhythmic precision and a faster tempo vis-a-vis faster paced strumming of the strings.

None of the devices in the identified prior art references appear to provide the capability to create the desired sounds with the desired timing and subject to the player's discretion as are provided by the present invention.

SUMMARY OF THE PRESENT INVENTION

Percussive or backbeat sounds are generally non-pitched rhythmic sounds, such as those typically heard sounding the backbeat, and often used as added sounds and/or accompaniments to music played by a variety of melody-producing or chord-producing instruments. For example, a drumbeat could be used to add a rhythmic accompaniment to a guitar piece, or to a vocal song.

In the main aspect of the present invention, a device for producing percussive sounds while playing a plucked string instrument containing a front surface, the front surface containing attached strings, the device comprising an arm disposed in a prefixed position, the arm containing an attached end and a free end, the free end of the arm being configured for pivoting down a predetermined distance around a hinge, the pivoting being in a direction substantially parallel to the front surface, the pivoting being actuated by a player's hand striking the arm as a continuation of a motion employed to strum the strings, wherein pivoting of the arm is configured for causing the actuation of a sound, the arm also being configured for rebounding back to the prefixed position after pivoting down the predetermined distance.

DETAILED DESCRIPTION OF THE INVENTION

Figure 1:
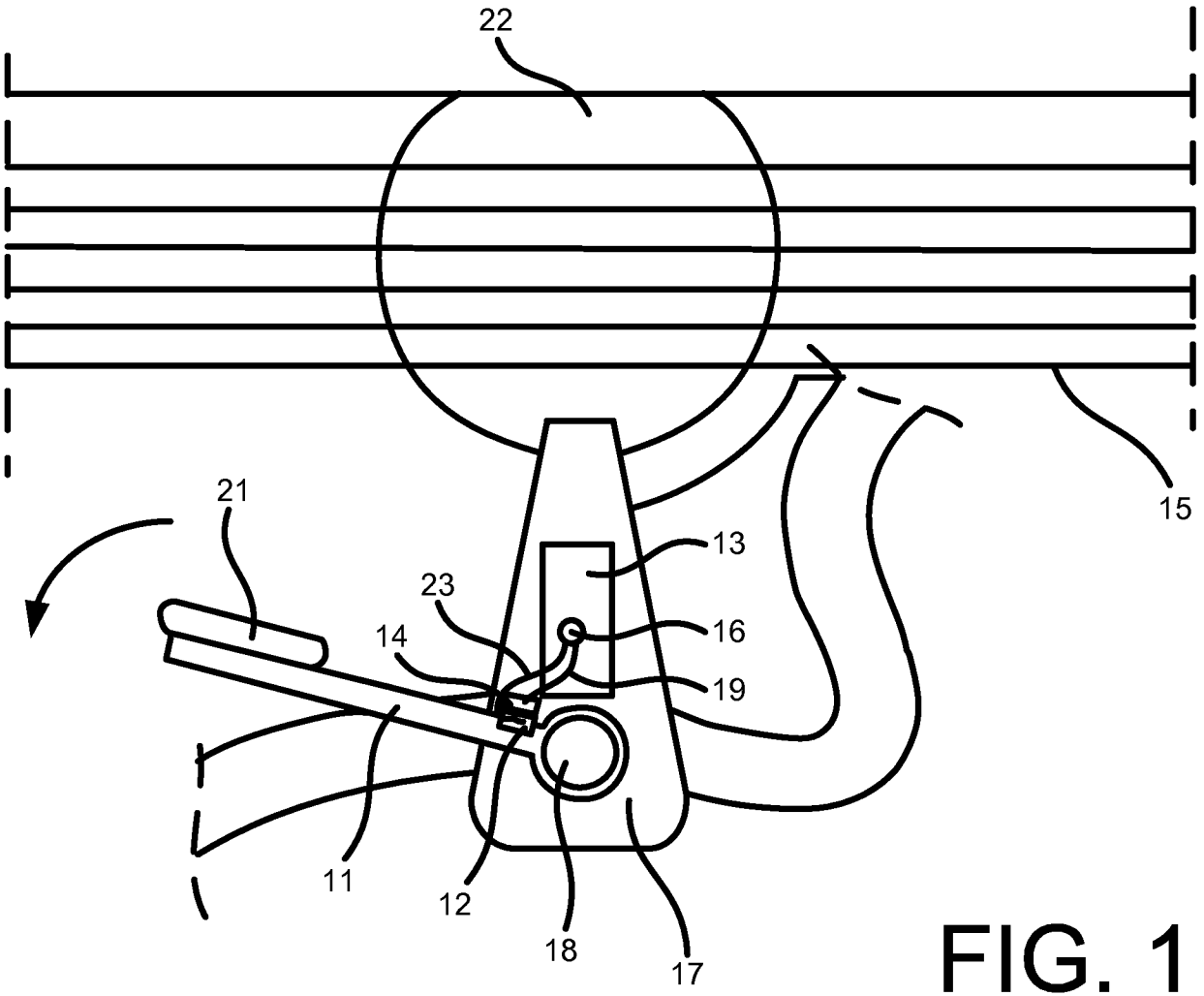
FIG. 1 is a front view of a first configuration of the device for producing percussive sounds attached to the front of a guitar according to an embodiment of the present invention.

The following detailed description is of the best currently contemplated modes of carrying out exemplary embodiments of the invention. The description is not to be taken in a limiting sense, but is made merely for the purpose of illustrating the general principles of the invention.

It is common for musical bands that include a number of musical instruments to add contrasting non-pitched sounds to certain types of compositions, which complement the rhythmic aspect of the music. These sounds typically emphasize certain components of repetitive rhythms. Common such sounds may be produced by percussion instruments such as drums or cymbals and may be referred to in the art as percussive sounds. When percussive sounds are heard coinciding with every second beat, the music is then said to possess a backbeat rhythm.

In a band, these sounds may be produced by adding appropriate musical instruments, but for a solo instrument player, such as for a guitar player, creating percussive sounds presents a significant problem since the player's hands are continuously occupied with playing the guitar. One solution available in the art is to provide a drum with drum mallets that are activated by the player using a foot pedal. There are two major shortfalls to this approach: 1) it requires the purchase and use of an additional instrument and 2) it requires that the player be highly skilled and coordinated to play two instruments at the same time.

The present invention offers a solution to this problem. In typical guitar playing technique, the player uses a plectrum held between his or her forefinger and thumb, to strum the guitar strings in a rapid motion from the upper strings to the lower strings viewing the guitar in the position as it is held by the player. The playing area, which is the portion of the strings being struck by the plectrum, typically lies over the sound hole of the guitar. After each downward strumming action, the player's hand tends to travel slightly further down than the stroke length necessary to strike the lowest strings, before being raised to position it for the next strumming action. The tendency of the player's hand to travel slightly further down than the stroke length necessary to strike the lowest strings may be referred to as overplaying the strings.

In the preferred embodiment of the present invention, a plate attached to the front panel of a guitar contains a swinging or pivoting arm assembly. The swinging arm is placed in a normal prefixed position in an area below the guitar strings in the playing area, i.e., in the area where the player maintains his or her strumming hand, such that the natural overplay could result in the hand striking the swinging arm. This causes the arm to swing down causing the actuation of an electric switch, which in turn actuates the transmission of a signal for playing a recording of a percussive sound. This may be accomplished within less than 0.01 seconds; therefore, the resulting percussive sound would virtually coincide with striking of the swinging arm. The swinging arm is attached to the plate with a spring loaded mechanism in such a way that the arm rebounds to its original position following the swing down making the arm ready for the next hand strike. The spring loaded mechanism only allows arm movement downward and resists a force that could otherwise bend the arm upward. The distance from the strings to the arm needs to be set appropriately such that the player's hand may reach it easily by overplaying the strings in the course of strumming, yet far enough such that a slight overplay does not result in hitting the arm by the player's hand. This provides the option of not striking the arm if the player so chooses. With this setup, the player can determine the times he or she would want to engage the percussive sound in the course of playing the guitar.

In the preferred embodiment of the present invention, a pad is attached to the free unattached end of the swinging arm for providing a soft surface for the hand strike. The preferred placement of the pad is below the area where the portion of the palm between the end of the small finger and the arm that contains the hypothenar muscles move to when the hand is in the overplay position approximately halfway between the point where the arm is attached, and the bridge of the guitar.

Attachment of the plate containing the arm assembly to the guitar must be done in a way that it is firm and does not allow movement of the assembly parts, which may cause damage to the wooden components of the guitar. In the preferred embodiment of the present invention, the plate contains an upper extension configured for clasping onto the lower edge of the sound hole and a lower extension configured for clasping onto the side of the guitar. A cord fastened to the upper extension is threaded under the guitar strings, wrapped around the guitar body and finally attached to the lower extension. The present invention allows for tightening the cord as it attaches to the lower extension as necessary and appropriate to achieve a stable attachment and without the risk of damage to the guitar.

Two electric switch designs for actuating the percussive sound fall within the scope of the present invention. The first embodiment comprises a first electric switch member attached to the arm and a second electric switch member that is contained within the plate assembly, situated above the first electric switch member and in contact with the first electric switch member. With this configuration, the electric switch circuit is closed when the arm is in the normal prefixed position. Striking the arm with the player's hand causes the arm to swing downward and to open the switch, an action which in turns triggers the transmission of the signal to play the recorded percussion sound. The second embodiment for the electric switch design is having the second electric switch member situated on the plate below the first electric switch member attached to the arm, and the two members normally disconnected from each other. With this configuration, the electric switch is open while the arm is in the normal position. Striking the arm with the player's hand brings the upper switch member into contact with the lower switch member thereby closing the electrical circuit and triggering a signal transmission. The transmission of the signal is triggered with this embodiment when the electric circuit closes.

It is desirable that the sound playing device be placed such that the player has convenient access to the volume and other controls. The audio signal generated when the recordings of percussive sounds are played will be transmitted to a sound reinforcement system by means of a cable. The following two embodiments for producing the percussive sound fall within the scope of the present invention:

1. The signal produced by either closing or opening the electrical switch is transmitted by means of a cable to a device that utilizes the timing of the signal to initiate playback of a recording of the desired percussive sound.

2. The signal produced by either closing or opening the electrical switch is transmitted by means of a radio signal to a receiver that picks up the signal. The receiver is included as component of a controller device, which, after the signal has been received, then issues a command to play a recording of a percussive sound, and the recorded sound is in turn transmitted, by means of a cable, to the input of a sound reinforcement system. This is the preferred embodiment of the present invention. The radio signal is preferably encoded and a decoder at the receiver is configured to decode the signal, thus accomplishing two objectives: first, to prevent any stray signals from other nearby devices from triggering the playback of percussive sounds, and second, to prevent signals generated legitimately by the present device from interfering with other devices in the vicinity. While the wireless signal transmission may be accomplished by a variety of means, Bluetooth® technology currently available on the market, which enables secure communication between various electronic devices through the use of radio signals, may be especially suited for this function. With a Bluetooth® device, a short range radio signal would be transmitted to an electronic computing implement such as a PC configured to initiate a command to play a prerecorded percussive sound. While less desirable, transmission of the signal through a cable also falls within the scope of the present invention.

Figure 2:
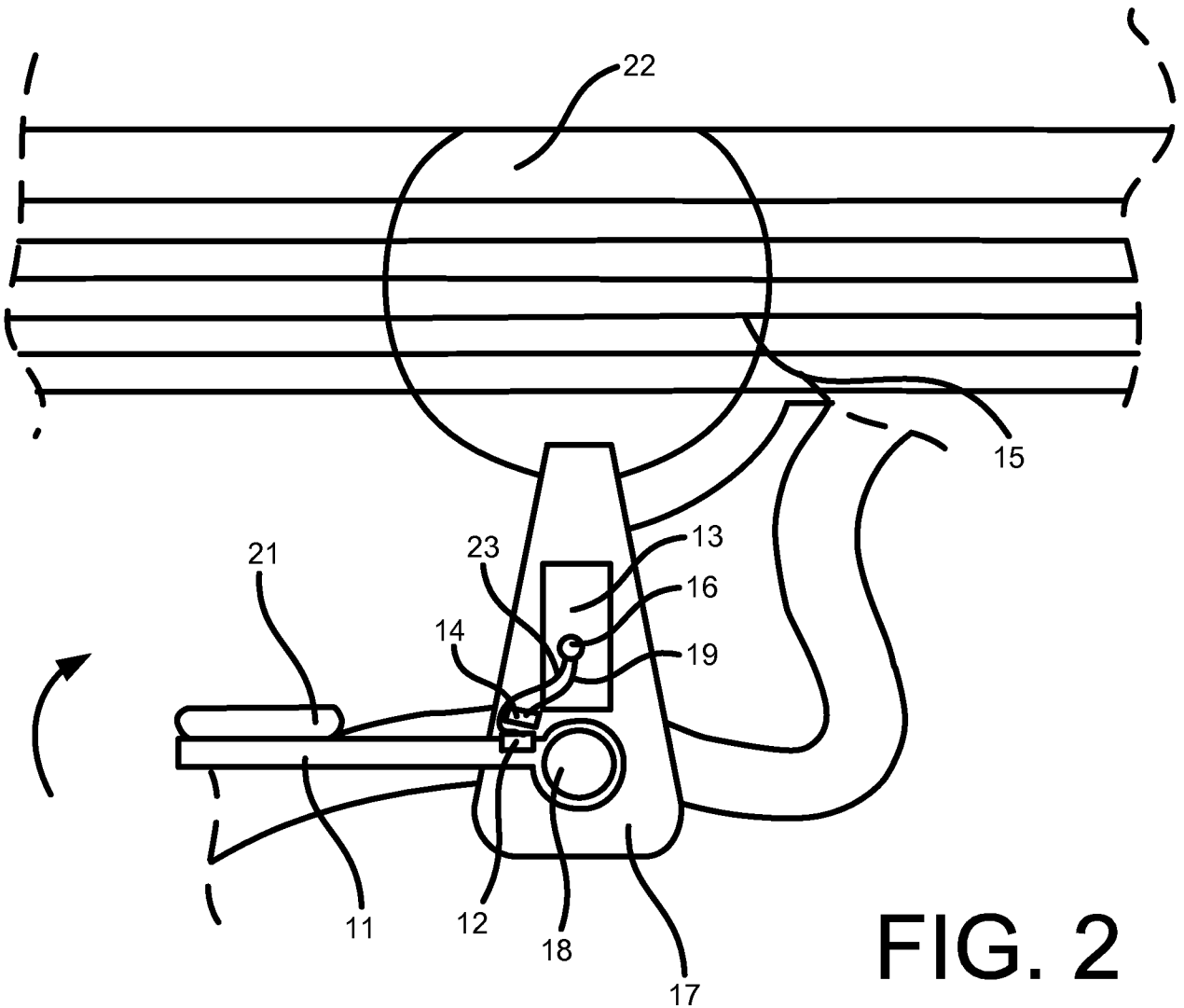
FIG. 2 is a front view of a second configuration of the device for producing percussive sounds attached to the front of a guitar according to an embodiment of the present invention.
Figure 4:
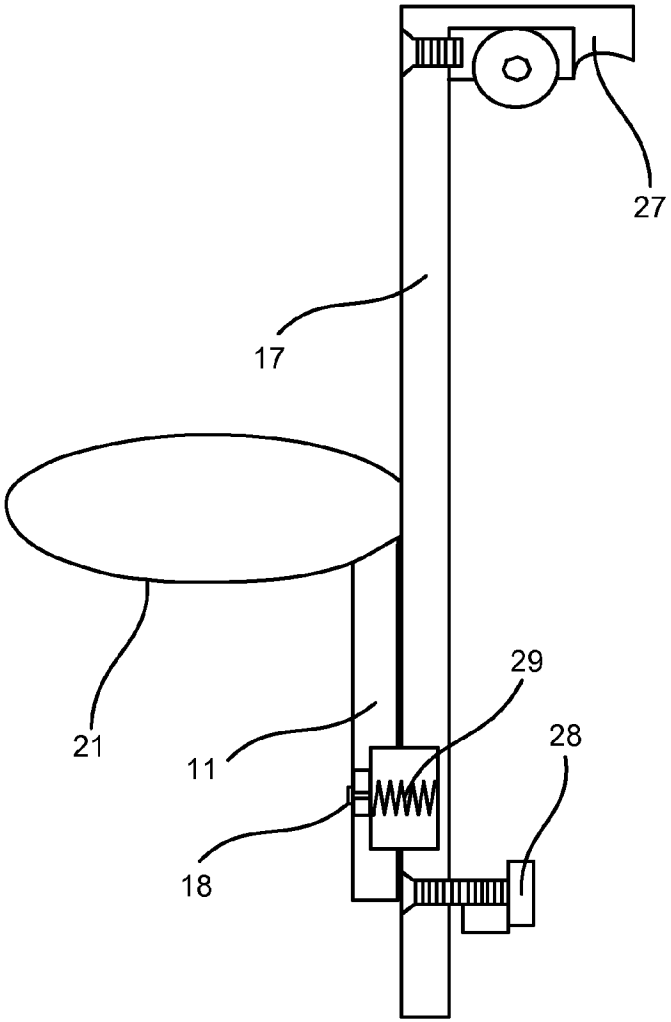
FIG. 4 is a side view of the device for producing percussive sounds that attaches to a guitar according to an embodiment of the present invention.
Figure 5:
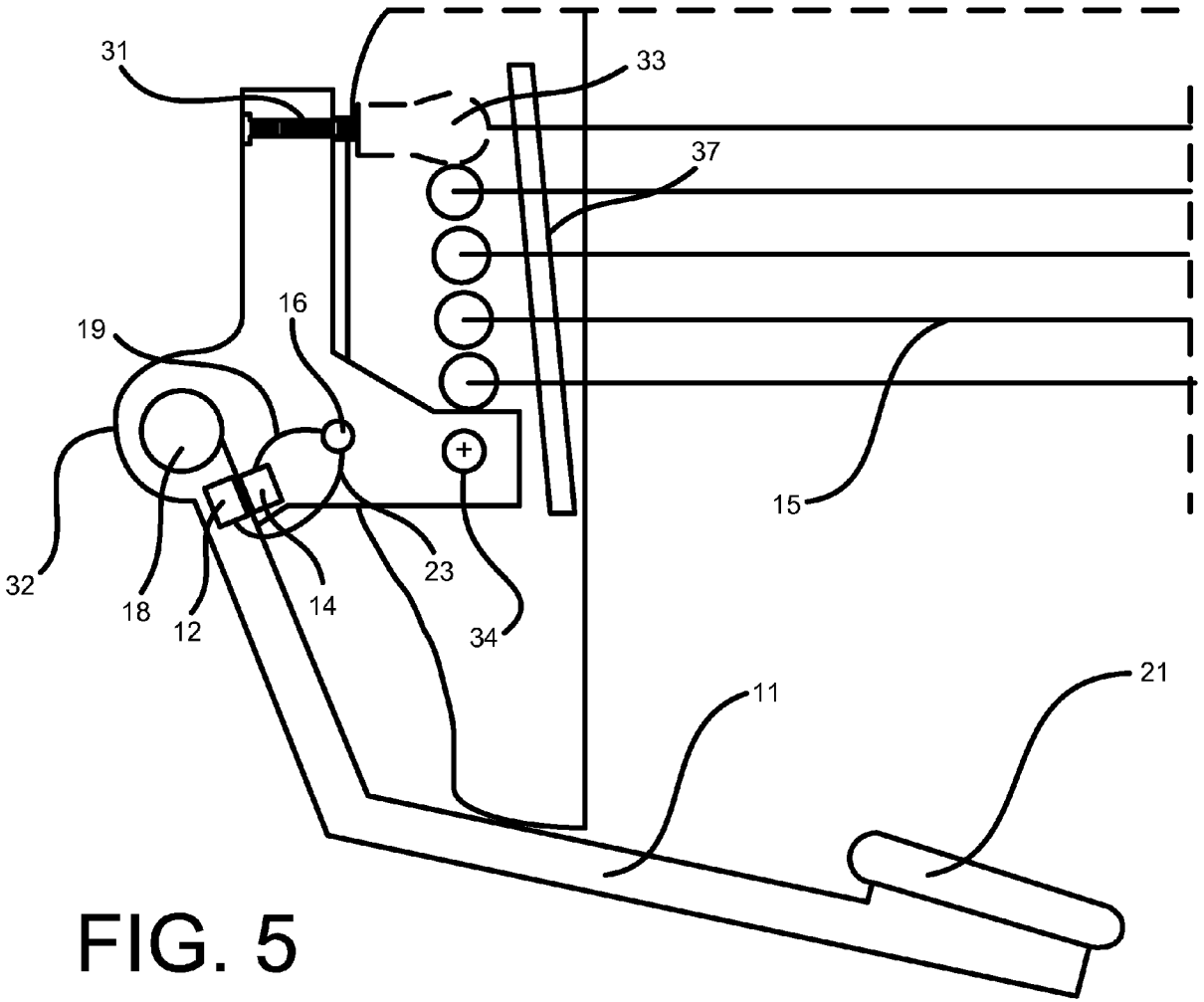
FIG. 5 illustrates a second embodiment for attaching the device for producing percussive sounds to a guitar.
Figure 6:
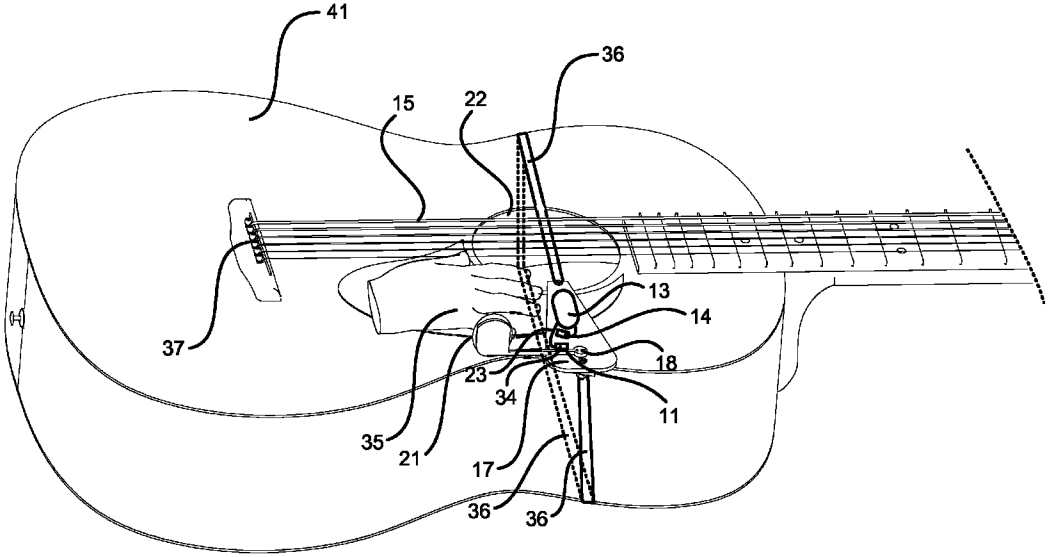
FIG. 6 is a bottom perspective view of a second configuration of the device for producing percussive sounds attached to the front of a guitar according to an embodiment of the present invention.

The device for producing percussive sounds is illustrated in FIGS. 1-9. The first embodiment for an electric switch design for actuating the percussive sound is shown in FIGS. 1, 2 and 6. Shown is a guitar 41 having a sound hole 22 and strings 15 anchored at the bridge pins 33 of the bridge 37. A plate 17 is attached to the lower front portion of the guitar 41 below the sound hole. An arm 11 is attached to the plate 17 at one end, while the other free end extends outwardly from the plate toward the bridge 37 and ending in an area below the strings 15 between the bridge 37 and the point of arm attachment to the plate 17. A pad 21 is attached to the free end portion of the arm 11. The normal prefixed position for the arm 11 is set at an acute angle relative to the strings 15 adjustable between about 5 degrees to about 20 degrees. The electric switch comprises of a first member 12 attached to the arm and a second member 14 situated above the first member 12. The upper switch member 14 and the lower switch member 12 are connected to an electrical control box 13 through wires 19 and 23 respectively.

In the normal position of the arm 11, the first member 12 and the second member 14 are in contact with each other as shown in FIG. 1. In this configuration, the two switch members form a closed electrical circuit. After the player's lower part of the hand 35 strikes the pad 21 the two switch members separate from each other thereby opening the electrical circuit. The attached end of the arm 11 contains a hinge 18 configured with a spring 29. The spring loaded mechanism allows the arm 11 to bounce back from a hand strike to its original position and be in position for the next strike. Immediately after the strike and before the arm bounce-back, the arm is substantially parallel with the strings 15 as shown in FIG. 2.

Figure 3:
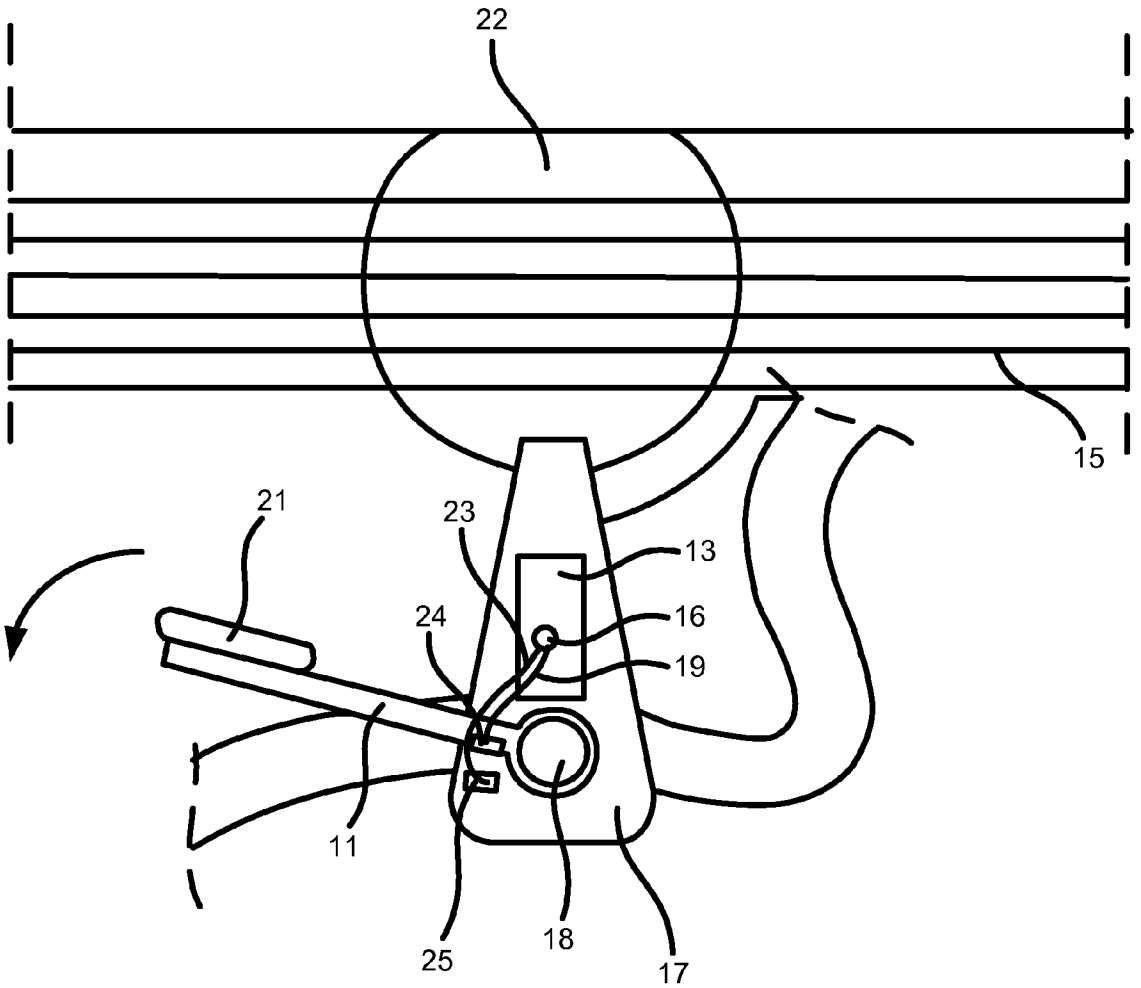
FIG. 3 is a front view of a third configuration of the device for producing percussive sounds attached to the front of a guitar according to an embodiment of the present invention.
Figure 8:
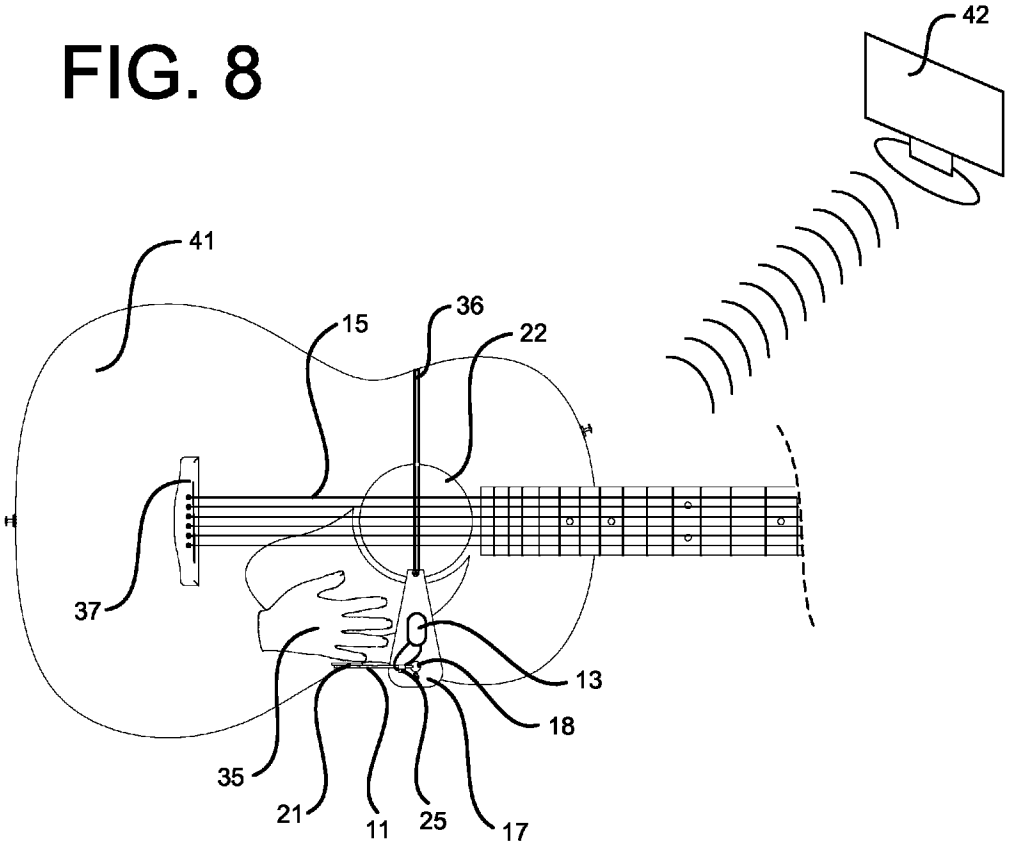
FIG. 8 is a depiction of the system for producing percussive sounds according to an embodiment of the present invention.
Figure 9:
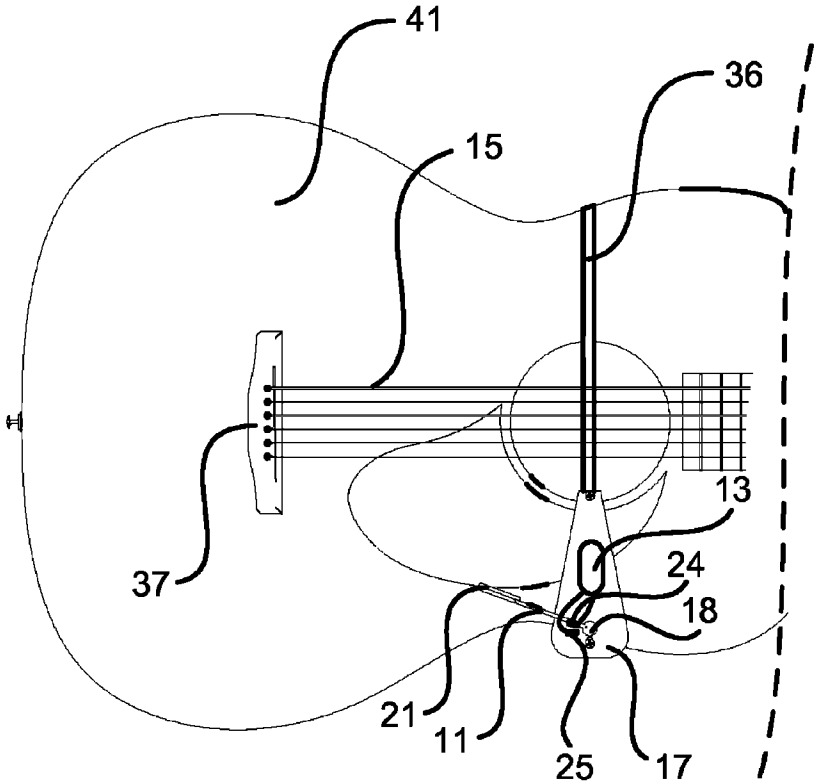
FIG. 9 represents another front view of the third configuration of the device for producing percussive sounds attached to the front of a guitar according to an embodiment of the present invention.

The second embodiment for an electric switch design for actuating the percussive sound is shown in FIGS. 3, 8 and 9. With this embodiment, the first electric switch member 24 attached to the arm 11 resides above the second electric switch member 25 and the circuit closes when the player's hand strikes the pad 21. Also attached to the plate 17 are control box 13 and radio transmitter 16. As the player's hand 35 strikes the pad 21 causing the electrical circuit to be closed, a radio signal is sent to a signal receiver and sound player device 42 as shown in FIG. 8. In another embodiment of the present invention, the transmission medium for the signal to a signal receiver and sound player device is a cable. The radio signal may be encoded at the transmission point and decoded at the receiving point by currently available technologies.

As can be seen in FIGS. 6 and 8, the pad 21 is positioned below the strings in the line of the guitar player's strumming hand overplay in such a way that the leading bottom edge of the player's hand strikes the pad. The design allows for sufficient distance between the strings 15 and the pad 21 such that the player could strum the strings but refrain from striking the pad. This gives the player the discretion whether to trigger the percussive sound or not as he or she feels appropriate.

It is important that the percussive sound substantially coincide with the strumming sound or to have an extremely short time delay.

Figure 7:
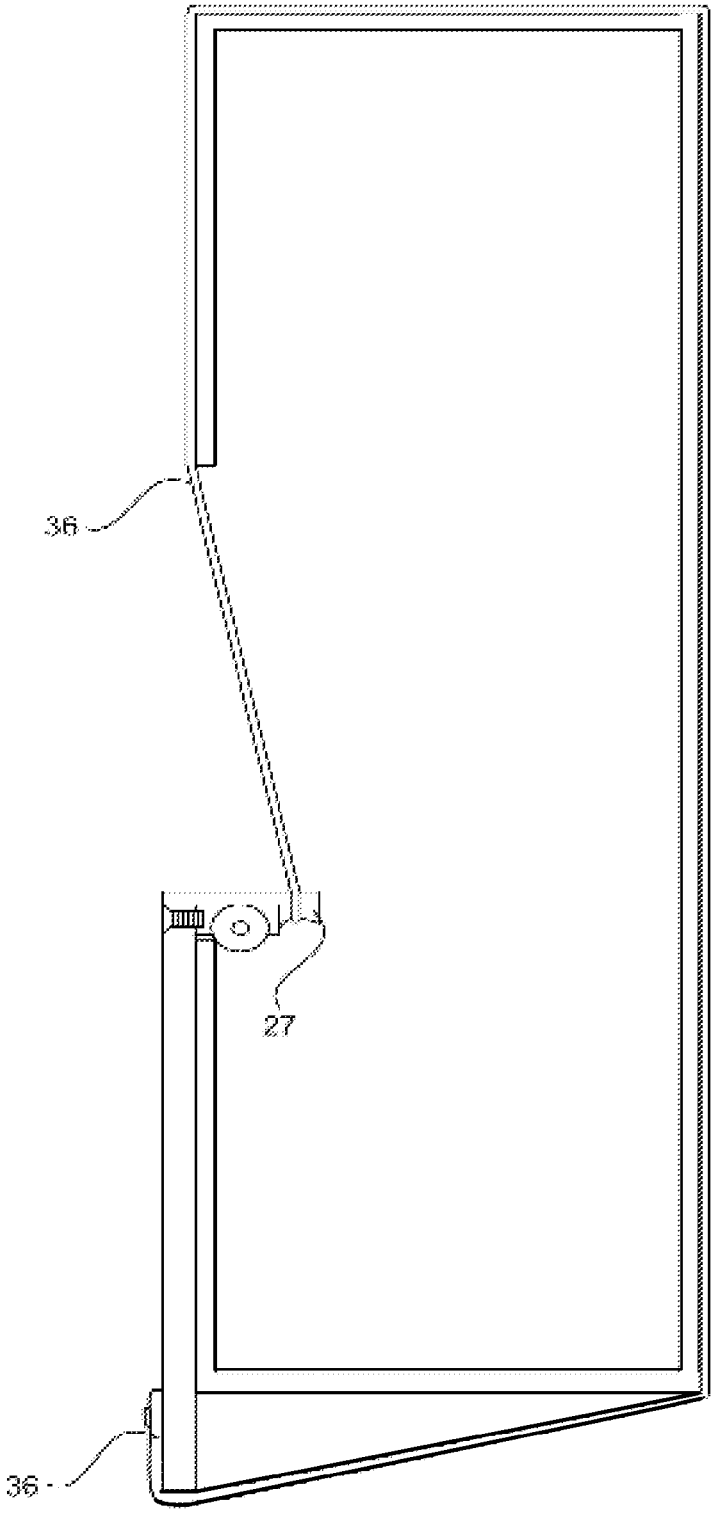
FIG. 7 illustrates a side view of a device for producing percussive sounds attached to a guitar according to an embodiment of the present invention.

The method for attaching the system for producing percussive sounds including the plate, the electrical circuitry, the arm and the pad to the guitar must be designed such that the guitar is not damaged. In the preferred embodiment of the present invention, the plate 17 is attached to the guitar with an upper extension 27 that clasps onto the lower edge of the sound hole 22 and a lower extension 28 that clasps onto the bottom side of the guitar. A cord 36 is fastened to the upper extension of the plate 17, threaded underneath the strings 15, wrapped around the body of the guitar and firmly secured to the lower extension of the plate 17 as illustrated in FIGS. 4 and 7. An alternate embodiment for attaching the plate assembly 17 is shown in FIG. 5, wherein an alternate design of the plate and swiveling arm assembly 32 is attached onto the bridge 37 by means of a long bolt and nut 34 extending through the plate and the hole normally occupied by the bottom bridge pin and also by an adjustable clamp 31 fastened onto the top bridge pin 33.

It should be understood, of course, that the foregoing relates to exemplary embodiments of the invention and that modifications may be made without departing from the spirit and scope of the invention.

I claim:

1. A device for producing percussive sounds while playing a plucked string instrument containing a front surface, said front surface containing attached strings, the device comprising an arm disposed in a prefixed position, said arm containing an attached end and a free end, said free end of the arm being configured for pivoting down a predetermined distance around a hinge, said pivoting being in a direction substantially parallel to the front surface, said pivoting being actuated by a player's hand striking the arm as a continuation of a motion employed to strum the strings, wherein pivoting of said arm is configured for causing the actuation of a sound, said arm also being configured for rebounding back to the prefixed position after pivoting down the predetermined distance.

2. The device for producing percussive sounds of claim 1 further comprising a pad attached to the free end of the arm.

3. The device for producing percussive sounds of claim 2, wherein the plucked string instrument is a guitar containing a bridge, a sound hole and strings extending over the sound hole from anchor points on the bridge and said pad being disposed in a location below the strings in an area between the bridge and the sound hole.

4. The device for producing percussive sounds of claim 3, further comprising a plate attached to the front surface of the guitar, said plate being attached below the sound hole, said plate containing a pivoting hinge for the attached end of the arm.

5. The device for producing percussive sounds of claim 4 further comprising an electric switch, said electric switch being activated by a hand of a guitar player striking the pad in such a manner that said activated switch actuates an electrical signal, said signal being transmitted to a device configured for actuating a sound.

6. The device for producing percussive sounds of claim 5, wherein the electrical signal is converted into a radio signal and the device configured for actuating the sound is configured to receive the radio signal and to activate playing a recording of a percussive sound, said percussive sound being generated within less than one half of a second following the guitar player striking the pad.

7. The device for producing percussive sounds of claim 6, further comprising an encoding device for transforming the radio signal into an encoded signal and a decoder for decoding the transmitted encoded signal.

8. The device for producing percussive sounds of claim 6, wherein transmittal of said signal is accomplished by a Bluetooth® device.

9. The device for producing percussive sounds of claim 5, wherein said electric switch comprises a first electric switch member attached to the arm and an electric switch member attached to the plate, said second electric switch member being situated above the first electric switch member and, with the arm in the prefixed position, being in contact with the first electric switch member thereby forming a closed electric circuit, wherein the player's hand striking the pad causing the arm to move downward opens the electric circuit and wherein opening the electric circuit triggers a signal transmission for playing the percussive sound.

10. The device for producing percussive sounds of claim 5, wherein said electric switch comprises a first electric switch member attached to the arm and a second electric switch member attached to the plate, said second electric switch member being situated below the first electric switch member, and, with the arm in the prefixed position, being disconnected from the first electric switch member thereby forming an open electric circuit, wherein the player's hand striking the pad causing the arm to move downward brings the first electric switch member and the second electric switch member in contact with each other to close the electric circuit and wherein closing the electric circuit triggers a signal transmission for playing the percussive sound.

11. The device for producing percussive sounds of claim 4 wherein attaching means of the plate to the front surface of the guitar comprise an upper extension to the plate, said upper extension being configured for clasping onto a lower edge of the sound hole of the guitar, a lower extension to the plate being configured for clasping onto a bottom portion of the guitar and a cord configured for attaching to the upper extension to the plate, for threading under the strings, wrapping around the guitar and for attaching to the lower extension to the plate.

12. The device for producing percussive sounds of claim 4, wherein attaching the plate containing the arm to the guitar is accomplished by bolting the plate through a bridge pin hole and an adjustable clamp fastened to a bridge pin.

13. The device for producing percussive sounds of claim 3, wherein the electrical signal is transmitted through a cable to a device configured to activate playing a recording of a percussive sound, said percussive sound being generated within less than one half a second following the guitar player striking the pad.

14. The device for producing percussive sounds of claim 3, wherein a portion of a player's hand adapted strike the pad in the course of strumming the guitar extends from the small finger to the arm.

15. The device for producing percussive sounds of claim 3, wherein the arm disposed in a prefixed position is positioned at an angle of between about 5 degrees and about 20 degrees relative to the strings of the guitar.

16. The device for producing percussive sounds of claim 15, wherein the arm is disposed in a substantially parallel position relative to the strings after the player's hand strikes said pad.

17. The device for producing percussive sounds of claim 1 wherein rebounding of said arm back to the prefixed position after pivoting down the predetermined distance is accomplished by a spring loaded mechanism.

* * * * *